United States Patent [19]

Woolfson

[11] 4,380,162

[45] Apr. 19, 1983

[54] MAGNETIC LOCK

[76] Inventor: Joseph W. Woolfson, 10 Montaque Ter., Brooklyn, N.Y. 11201

[21] Appl. No.: 637,961

[22] Filed: Dec. 5, 1975

Related U.S. Application Data

[63] Continuation-in-part of Ser. No. 539,285, Jan. 8, 1975, abandoned.

[51] Int. Cl.[3] ..... E05B 47/00; E05B 19/26

[52] U.S. Cl. ..... 70/276; 70/413

[58] Field of Search ..... 70/276, 413, 363

[56] References Cited

U.S. PATENT DOCUMENTS

| | | | |
|---|---|---|---|
| 1,494,765 | 5/1924 | Barrett | 70/363 |
| 3,270,538 | 9/1966 | Kerr | 70/363 |
| 3,393,541 | 7/1968 | Wake | 70/276 |
| 3,782,147 | 1/1974 | Hallmann | 70/276 |
| 3,837,195 | 9/1974 | Pelto | 70/413 |

*Primary Examiner*—Kenneth Dorner

*Attorney, Agent, or Firm*—Hubbell, Cohen, Stiefel & Gross

[57] ABSTRACT

A magnetic lock wherein the movable portion is sandwiched between two stationary portions. The movable portion carries a plurality of transversely slidably movable magnets which serve as pin tumblers that fit into recesses or cavities in either stationary part to lock the movable member against movement. Fixed to one of the stationary parts are means for biasing the pin tumbler magnets toward the other stationary part whereby to hold the lock in unlocked condition. The key is placed adjacent the other stationary part and carries magnets poled to repel the pin tumbler magnets with an equal and opposite force to the biasing means to locate the pin tumblers wholly within the movable part so that the movable part may be moved. Preferably, at least two of the biasing means have different strengths for biasing the pin tumbler magnets.

36 Claims, 18 Drawing Figures

MAGNETIC LOCK

RELATED APPLICATION

This application is a continuation-in-part of my earlier filed co-pending application, Ser. No. 539,285 filed by me on Jan. 8, 1975 now abandoned.

BACKGROUND OF THE INVENTION

1. Field of the Invention

This invention relates to locks and particularly to magnetic locks. Most particularly, this invention relates to a magnetic lock which is highly pick-resistant.

2. The Prior Art

Magnetic locks have been known for many years. Thus, for example, U.S. Pat. No. 2,931,953 granted to W. Barney on Apr. 5, 1960 discloses a latching device wherein a movable member is locked against movement by a transversely extending magnetic pin which is normally biased into a complementary aperture in a stationary part as by gravity. However, when a key is inserted into the lock, the key carries a magnet that is poled so as to repel the magnetic pin in the movable whereby to unlock the lock. The problem with a device such as Barney's is that so long as a minimum field strength is provided for the magnet in the key, it will suffice to repel the movable magnetic pin whereby to unlock the Barney lock. This being the case, it is a relatively simple matter to unlock Barney by having two keys with the magnets therein of considerable magnetic strength and being oppositely poled. By a simple trial and error process requiring a maximum of two trials, the Barney lock could be unlocked. A similar problem is encountered with Felson U.S. Pat. No. 3,111,834 wherein a plurality of magnetic pin tumblers are provided in the plug of the lock, each being biased to bridge the shear plane of the lock by a like poled magnet in the shell. When a key is inserted which bears magnets that are like poled to the pin tumblers, the tumblers will be repeled by the magnets in the key whereby to clear the shear plane and unlock the lock. Again, there is no consideration for the amount of field strength required for the magnets in the key of the Felson lock, so long as a minimum field strength is attained. Thus, for each pin tumbler in the Felson lock, there are only two possibilities. This being the case, the number of keys necessary to cover all possibilities is only $2^n$, where "n" is the number of magnetic tumblers in the Felson lock. For example, a five-pin tumbler will require only a set of 32 keys, a practical number for a burglar to carry to open the lock.

A similar problem exists in the magnetic lock described in Felson U.S. Pat. No. 3,416,336 which is similar to the earlier discussed Felson patent save for the fact that the pin tumblers are moved by magnetic attraction rather than by magnetic repulsion. The same inherent weaknesses may be found in this patent as in the earlier Felson patent. This is likewise true of the locks described in Wake U.S. Pat. No. 3,518,855.

SUMMARY OF THE INVENTION

The invention lies in the perception that if the pin tumblers in a plug or movable portion of a lock are magnetized, they may be moved to an unlocked position by opposed magnets which have an equal and opposite repelling effect on the pin tumbler magnet. Thus, if there are a plurality of pin tumbler magnets which are in register with stationary magnets poled to repel the pin tumbler magnets, the pin tumbler magnets will normally straddle the shear plane of the lock and thereby hold the lock in locked position. When the key, carrying magnets of appropriate polarity and field strength to repel the pin tumbler magnets with an equal and opposite force from the first mentioned magnets, is operated to bring the key magnets into register with the pin tumbler magnets, the pin tumbler magnets move to a position wholly within the plug to unlock the plug and hence the lock.

DETAILED DESCRIPTION OF PREFERRED EMBODIMENTS

Figure 1:
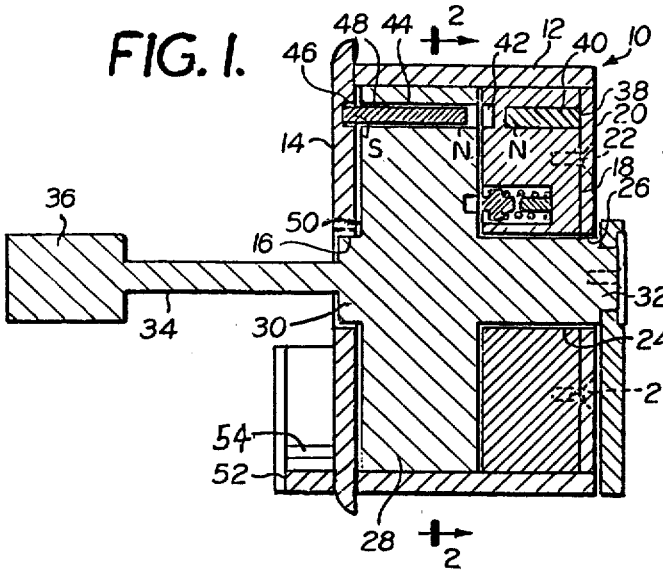
FIG. 1 is a longitudinal sectional view of a lock embodying the present invention with no key in place.
Figure 2:
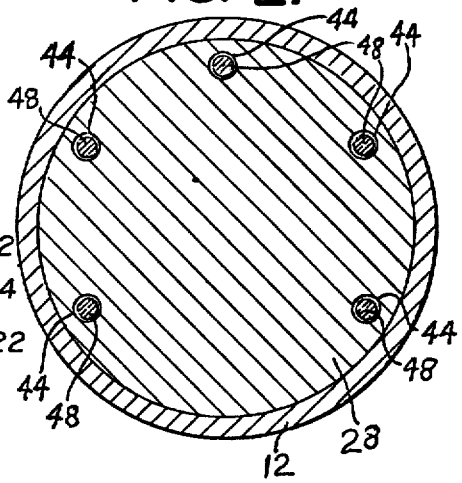
FIG. 2 is a sectional view taken along the line 2—2 of FIG. 1.

A circular key lock embodying the present invention is illustrated in FIGS. 1 through 5. The lock is generally designated by the reference numeral 10 and comprises a stationary outer shell 12 having a flanged front plate 14 fixed thereto as by screws, brazing, soldering, welding or the like. The front plate 14 is provided with a central aperture 16 for reasons which will become apparent hereinafter. Disposed within the shell 12 at the rear thereof is a stationary piece or slug 18 which is fixed to the shell 12 as by screws, although other securement means may be employed. The back plate is secured to the slug 18 as by screws 22, brazing, welding, soldering or the like. The stationary piece or slug and the back plate 20 are both provided with a central aperture 24 and 26, respectively, which are in alignment with one another and with the aperture 16. Disposed between the front surface of the piece 18 and the rear surface of the front plate 14 is a rotor or plug 28 having forwardly and rearwardly extending axial bosses 30 and 32 which are journaled respectively in the apertures 16, 24 and 26 for rotatably mounting the rotor within the shell. To effectuate rotation of the rotor, a shaft 34 extends forwardly from the boss 30 and has at its forward end a knob 36 for manual gripping for rotating the rotor. Preferably the rotor 28, including its bosses 30 and 32 as well as shaft 34 and knob 36, is integrally formed as from brass or other non-magnetic material as by machining or casting or other suitable manufacturing process. Thus, lock 10 has two major components, a stator comprising back piece or slug 18, front plate 14 spaced from the back piece, and shell 12 bridging the space between piece 18 and plate 14 and connecting the two; and rotor 28.

As shown herein by way of example, the rear of piece 18 is provided with five cavities 38 which are preferably arranged in a circular row and which are all closed off by the rear plate 20. Clearly the number of holes 38 is a matter of choice and may be any suitable number. It will become apparent from the following description that the more holes, the more resistant will be this lock to unauthorized opening. Fixedly disposed in each of the holes 38 is an elongated magnet 40. The magnets 40 must all pole the same way, that is all of the north poles or all of the south poles are at the forward end of the magnets 40. By way of example, all of the north poles "N" are shown at the forward end. Extending in from the front base of the stator 18 are a like number of cavities 42 which are in alignment with the cavities 38 and the magnets 40. While the cavities 42 are shown separate from the cavities 38, each pair may be from a single through aperture in slug 18 with the magnets 40 press-fitted into the rear portion of such through aperture whereby to leave a hollow cavity 38 at the front face of the stator at each aperture.

Extending through the main body portion of the rotor 28 are holes 44 which holes are preferably of essentially the same diameter as the cavities 42 and 38 and are in alignment therewith. Provided in the rear face of the front plate 14 are a plurality of circular recesses or cavities 46 which recesses are in alignment with the apertures 38, 42 and 44 and of like diameter. Disposed in each hole 44 in the rotor 28 is a rod-like magnet 48 which magnet is reciprocably movable within its aperture 44. Magnets 48 are not longer than holes 44. The magnets 48 are all poled so that their right or rear ends are of like polarity to the confronting poles of magnets 40 whereby to be repeled thereby. As may be seen in FIG. 1, the repulsion of the magnets 48 by the magnets 40 results in the magnets 48 all being moved forwardly so that the front ends thereof, that is the south poles thereof in the example illustrated, are all disposed in their corresponding recesses 46 in the rear surface of the front plate 14. This causes the magnets to bridge the plane between the front surface of the rotor 28 and the rear surface of the plate 14, which plane shall be designated as shear plane 50, whereby to prevent rotary movement of the rotor relative to the plate 14 and hence to the entire stator. Thus lock 10 is locked.

Figure 5:
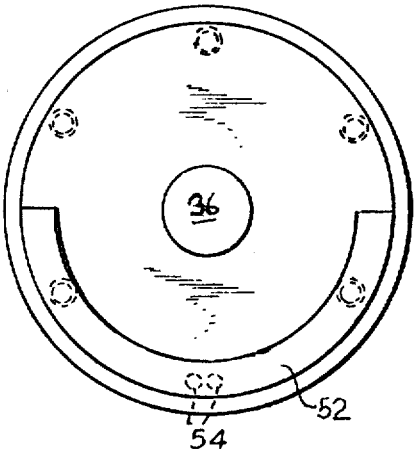
FIG. 5 is a front elevational view of the lock of FIGS. 1 through 3.

As may best be seen in FIGS. 1 and 5, fixed to the front plate 14 adjacent the bottom thereof, is a an L-shaped arcuate flange 52 which, as will be understood hereinafter, serves as the indexing means for the key for the lock 10. Further indexing of the key may be provided by two spaced apart rods 54 that extend between the front of plate 14 and the vertical portions of the L-shaped flange 52 adjacent the bottom thereof.

Figure 3:
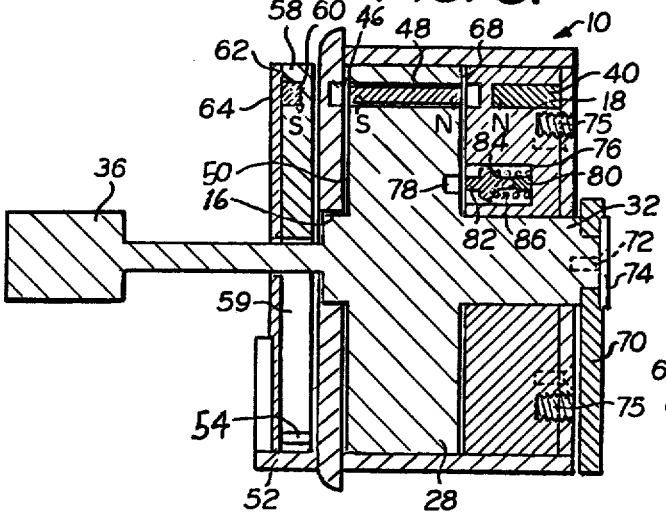
FIG. 3 is a view similar to FIG. 1, but showing the key inserted into the lock and the lock in an unlocked condition.
Figure 4:
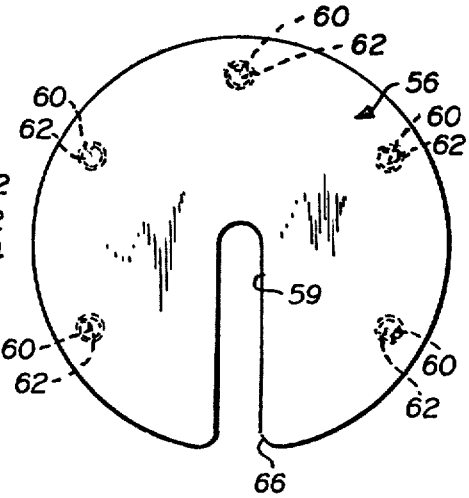
FIG. 4 is an elevational view of the key for the lock of FIGS. 1 through 3.

The key for the lock 10 is shown in FIGS. 3 and 4 and is designated by the reference numeral 56. As shown herein, the key comprises a circular plate 58 preferably of the approximate diameter of the inside of the shell 12. Plate 58 is provided with a radially extending cutout 59 of slightly greater width than the diameter of the boss 30 to enable it to slide around the boss. Distributed in a circular row adjacent the periphery of the plate 58 are a plurality of cavities 60 which are registrable with the apertures 44 in the rotor 28. Disposed within the cavities 60 are magnets 62 which are poled oppositely to the magnets 48 in the rotor 28 so as to establish a repelling force between the magnets 62 and the magnets 48. Thus, as shown in FIG. 3, the rear surface of the magnets 62 constitute the south poles thereof. Overlying the front face of the plate 58 to cover the holes 60 and the magnets 62 is a cover plate 64 which is secured to the plate 58 in any suitable fashion, preferably by brazing or the like, although screws could be employed. The cover plate 64 has a radial cutout that registers with the cutout 59 in the plate 58. The key 56 is inserted into the lock by moving it vertically downwardly with the boss 30 disposed in the slot 59 until the bottom of the key rests in the bottom of the arcuate flange 52. The pins 54 are spaced so as to properly align the magnets 62 with the magnets 48. To facilitate this alignment the lower end of the radial cutout 59 is preferably moderately chamfered as at 66.

In accordance with the present invention, the field strengths of the magnets 62 are such as to repel the magnets 44 with a force that is equal and opposite to the repelling force established between the magnets 40 and 48 when the magnets 48 are disposed as shown in FIG. 3. Accordingly, with magnets 48 in the position shown in FIG. 1, when key 56 is inserted in lock 10, key magnets 62, being closer to magnets 48 than normal (FIG. 3), will repel the magnets rearwardly until the opposed repelling forces are equal. At that point, save possibly for some transient damped oscillation, the magnets 48 will come to rest as shown in FIG. 3. It will be seen that with the longitudinal extent of the magnets 48 somewhat less than the thickness of the rotor 28, the magnets 48 are wholly within the rotor and do not extend across either the forward shear plane 50 or the rest shear plane 68. Thus, none of the magnets 48 will bridge either shear plane, whereby to unlock the rotor from the stator and permit turning of the rotor as by gripping the knob 36 and torquing it.

It should be noted that in the embodiment of FIGS. 1 to 5, all of the magnets 40 are similarly poled as are the magnets 48. The reason for this is that when the key 56 is disposed within its seat defined by arcuate flange 52 to repell movable magnets 48 so that they are disposed between the two shear planes 50 and 68 whereby to free the rotor 28 for rotation since the magnets 48 are arranged in a circular row, they will, during the rotational movement of rotor 28, sequentially register with other aligned pairs of magnets 40-62. If the magnets 40-62 are not all poled the same (whereby the magnets 48 would not all be poled the same), then at some point in its travel, each magnet 48 will be subject to mutual attraction rather than mutual repulsion. While as a matter of theory, mutual attraction will function as well as mutual repulsion, it will be seen that if any imbalance in forces occurs to shift the movable magnets 48 out of their equilibrium position, this will result in the magnet 48 moving all of the way to an extreme position to thus lock the lock. It will be obvious that this is avoided in the FIGS. 1 to 5 embodiment by having all of the magnets poled the same, whereby to result in equal repulsion forces or the magnets 48 irrespective of which pair of stationary magnets 40–62 the magnets 48 are in register with. This problem might also be avoided by not having the magnets 40–48–62 arranged in circular rows in which case similar poling might not be required.

Preferably, although not necessarily, the magnets 40 are not all of the same field strength but are of significantly different field strengths. Thus, for example, the field strengths of the magnets 40 can be arranged to be of one of a number of different strengths of significantly different values. This being the case, the magnets 62 in the key 56 will have to be of similar different strength values so that when the key is placed in the lock, magnets 62 will set up equal and opposite repelling forces on the pin tumbler magnets 48 to those of magnets 40, whereby to equally repel the magnets 48 and cause them to be located between the shear planes 50 and 68 to unlock the lock. Once the lock is unlocked by insertion of a properly coded key 56, the rotor can be turned by manipulating the knob 36 and the magnets will remain between the shear planes 50 and 68 by virtue of the fact that each time the magnets 48 come into register with an opposed pair of magnets 40–62, the magnet 48 will encounter equal and opposite repelling forces which will hold the magnets 48 in their unlocked position.

As is conventional in many locks, a suitable deadlock operating member such as leverlike member 70 is secured to the rear end of the boss 32 as by screws 72 and a plate 74 to cause the lever 70 to rotate with the rotar 28 to operate a suitable mechanism as in a deadlock or the like. The lever 70 is merely shown by way of example. As the skilled art worker well knows, there are a number of output devices which can be secured to the plug of a key for operating a locking mechanism. Any of these may be adopted to the lock 10. Any conventional means such as internally threaded holes 75 at the back of lock 10 may be employed for mounting the lock in a deadlock or the like.

To avoid any problems of stray magnetic fields or the like, it is preferred that, save for the magnets 40, 48 and 62, all of the material of the lock 10 and the key 56 be of non-magnetic material such as brass. Clearly other non-magnetic materials may be employed without departing from this invention. The magnets may be made of any suitable magnetic material. Thus, sintered or cast magnets may be employed, and iron or Alnico magnets may be employed. In a device actually embodying this invention and constructed by the inventor hereof, sintered Alnico magnets were employed.

The effective field strengths of the magnets 40 and 62 which must be matched in order to mutually repel the movable pin tumbler magnets 48 to cause them to move into the unlocked position shown in FIG. 3 may be achieved in several ways. Clearly, the strength can be adjusted by the degree of magnetization of the same material. Another manner of adjusting field strengths is to adjust the amount of magnetic material present in the magnet. That is, a half-inch of magnet magnetized to a certain degree will exhibit more strength than a quarter-inch of the same magnetic material magnetized to the same degree. This technique has been successfully employed by applicant. Still another way of adjusting effective field strengths is to adjust the effective spacing between the respective shear planes and the confronting ends of the magnets 62 and 40 that may be of the same degree of magnetization, suitably non-magnetic spacers being employed to adjust the spacing between the magnets and the adjacent shear plane. Another manner of varying effective field strength is by selection of magnetic materials. This technique has been employed by applicant by using sintered Alnico 2 and sintered Alnico 8. In fact both material selection and adjustment of amount of material were used in a single model of applicant's invention. While the field strengths of magnets 48 are not critical to the operation of lock 10, it is preferred that magnets 48 be of different field strengths as this enhances the pick resistant quality of the lock.

The manner of constructing the lock 10 will be obvious to the skilled art worker. Thus, for example, the shell 12 and the front plate 14 may be first assembled as by brazing, soldering, welding or the like. Then the unitary rotor assembly may have the pin tumbler magnets 48 slidably disposed in holes 44 therein and the assembly may be slide into the shell through the rear thereof until the front of the stator 28 engages the rear surface of the front plate 14. The slug 18 is then pressed into the rear of the shell 12 until it is in close confronting relation with the rear surface of the rotor 28. Clearly before this is done, it is preferred to press the magnets 40 into the apertures 38 in the slug 18. Then the rear plate 20 is slid into the shell 12 up against the rear surface of the slug 18 and is secured to the stator as by the screws 22 and is secured to the shell as by screws or by soldering, brazing, welding or the like. If desired, shell 12, arcuate flange 52 and front plate 14 may all be cast as an integral unit.

Assuming each of the magnets 40 can have any of a significant number "X" of field strengths, the permutations and combinations of keys 56 that have to be constructed in order to be sure that one has constructed a key that will open the lock 10 is so large as to render such an approach impossible.

The mathematical expression to determine this number is $2X^A$ where A is the number of pins. Thus, for a five-pin lock wherein four different field strengths are employed, the number of possibilities is 2,048. Clearly, too much field strength in a key magnet will result in a key which will not unlock the lock as it will repel the pin tumbler too much and thus cause it to straddle the shear plane 68 which is a locking position. Beyond this impracticable approach to opening the lock 10, there is no standard way of picking a lock of the construction of lock 10. Thus, the lock is essentially pick-proof.

The only possibility which the applicant has foreseen as an approach to picking of a lock of the type of lock 10 would be to subject the entire lock 10 to a very large AC field and then to slowly diminish the field thereby to demagnetize all of the magnets 40, 48 and 62. This of itself will not unlock the lock because when this is done, all of the magnets 48 will be bridging the shear plane 50 to hold the lock in its locked condition. However, it is conceivable, although highly unlikely, that if after all the magnets were demagnetized, a vibrator were brought into mechanically coupled relation with the rotor 28, as by bringing it into engagement with the knob 36, and the rotor was subjected to vibration while the rotor is being torqued, the random movements of the demagnetized pin tumblers 48 might for a brief interval place them all in the positions of FIG. 3. If torque were being applied during that brief interval, the rotor would rotate and lock 10 would be unlocked. While this possibility is extremely remote, if it is desired to guard against it, a simple expedient may be employed which expedient is illustrated in both FIGS. 1 and 3. As shown in FIGS. 1 and 3, the slug 18 is provided in its front face with a hole 76 which hole is in confronting relation with a cavity 78 in the rear face of the rotor 28 when the rotor is in its locked position. Fixedly disposed in the rear of the aperture 76 is a magnet 80 and slidably disposed in the aperture 76 forward of the magnet 80 is a second magnet 82 that is poled to be attracted by the magnet 80. As shown, magnet 80 is somewhat smaller than the diameter of aperture 76 and is fixed to the rear surface of that aperture as by an adhesive or the like. Surrounding the magnet 80 and extending forwardly therefrom into engagement with a radially extending boss 84 on the magnet 82 is a spring 86 tending to push the magnet 82 forwardly into the cavity 78. However, the magnetic attraction between the magnets 80 and 82 is more than enough to overcome the bias of the spring 86. Thus, normally, the movable magnet 82 is disposed wholly within the aperture 76 and is out of the shear plane 68 of the lock 10. However, should someone attempt to demagnetize the lock for the purposes of unauthorized opening as previously mentioned, such demagnetization will be effective for demagnetizing the magnets 80 and 82. Upon this occurring there will be no more magnetic attraction between the magnets 80 and 82, whereby to permit the spring 86 to push the demagnetized movable magnet 82 forward across the shear plane 68 and into the aperture 78 to thereby maintain the lock locked even if it is subjected to vibration. Thus, an extremely high degree of security is achieved by lock 10.

Referring now to FIGS. 6 through 9, a second embodiment of the present invention is shown wherein the lock is a more conventional flat key lock generally designated by the reference numeral 100. The lock 100 is provided with a cylindrical outer shell 102 preferably having a flanged annular front plate 104 fixed thereto as by soldering, brazing, welding or the like. Fixed to the interior of the shell 102 as by screws 105, although other means may be employed, is an annular stator portion 106. Disposed preferably in a row at the top of stator portion 106 are a plurality of cavities 108 in which are disposed a like plurality of stationary magnets 110. In line with the cavities 108 in stator portion 106 but on the inside of the annulus are a like plurality of upwarding extending cavities 112. Clearly, each pair of cavities 112 and 108 may be formed from a single through hole with the magnets 110 being press-fitted securely into the upper portions thereof and held therein by friction, adhesive or the like.

Figure 6:
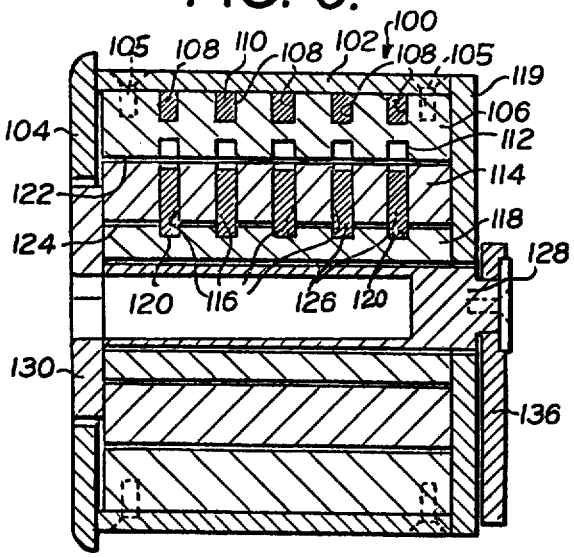
FIG. 6 is a longitudinal sectional view of an alternate embodiment of the present invention showing the lock in a locked condition.
Figure 7:
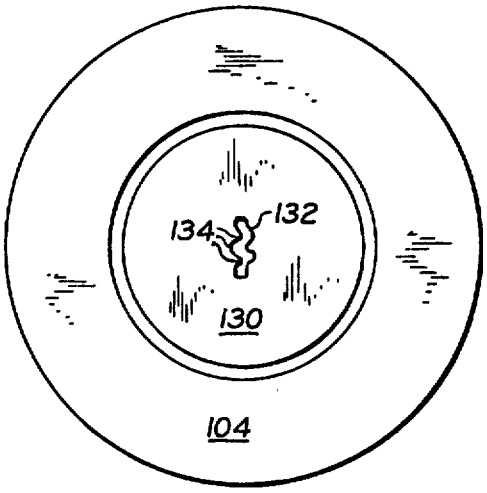
FIG. 7 is a front elevational view of the lock of FIG. 6.

Rotatably mounted in the outer annular stator portion 106 of lock 100 is an annular plug portion 114 having a like plurality of through holes 116 therein which are registrable with the cavities 112 and 108 when the lock is in its locked position shown in FIG. 6. Disposed within the annular plug portion 114 is a second or inner annular stator portion 118 that is fixed to the outer stator portion 106 and the shell 102 as by a back plate 119 that is secured to both annular portions 106 and 118 of the stator as by screws or the like, but which is not connected to the intervening annular rotor or plug portion 114. The inner stator portion 118 is provided in its outer surface with a like plurality of cavities 120 that are in alignment with the cavities 112. Preferably, cavities 108, 112 and 120 and holes 116 are all of the same diameter.

It will be seen that the annular plug or rotor portion 114 defines at its outer surface a first shear plane 122 with the inner confronting surface of the outer stator portion 106 and defines a second shear plane 124 at its inner surface together with the confronting outer surface of the inner stator annulus 118.

Slidably disposed within the apertures 116 in the rotor or plug portion 114 are a plurality of magnets 126, preferably one for each aperture 116, which are in repelling polar relation with stationary magnets 110 and are further biased as by gravity into the recesses 120 in the inner stator portion 118 whereby to bridge the shear plane 124 and lock the lock 100. The length of magnets 126 does not exceed the radial extent of plug portion 114. The innermost portion of the lock 100, which is a second plug portion 128 is fixed to the outer plug portion 114 as by a front plate 130 connected to both plug portions in a suitable way, such as, for instance, brazing. Provided in the inner plug portion 128 is a keyway 132 which preferably is of irregular cross-section as would result from the provision of longitudinally extending flutes, ridges or grooves generally designated by the reference numeral 134 so that it will accept a key of only one complementary cross-section. The rear end of the inner plug or rotor portion 128 may be secured to any suitable operating member such as a lever 136 to operate the mechanism of a deadlock or the like. This aspect of the lock is wholly conventional and need not be described.

To unlock the lock 100, a key 138 having a longitudinally extending shank 140 of irregular cross-section complementary to the shape of the keyway 134 and a suitable outwardly extending handle portion 142 for turning the key is provided. Distributed along the length of the shank 140 of key 138 are a like plurality of magnets 144 which are located so as to register with the magnetic pin tumblers 126 when the key 138 is fully inserted into the keyway 132. Magnets 144 fixed to shank 140 as by press-fitting them into distributed cavities in the key shank with or without adhesive. Assuming the magnets 144 are poled so as to repel the magnets 126 with a force equal and opposite the repelling force between the magnets 126 and the magnets 110, the pin tumbler magnets 126 will locate themselves wholly within the volume of the outer plug or stator portion 114 to thereby clear both shear planes 122 and 124 and unlock the lock. The lock may then be operated by grasping the portion 142 of the key 138 and turning the lock.

It will be recognized that in the lock 100, the forces of gravity enter into the consideration for balancing the forces on magnets 126, a consideration not present in the configuration of the lock 10. While this must be taken into account when designating a lock 100, for the purposes of this description, when it is stated that the repelling force between magnets 144 and the pin tumbler magnets 126 is equal and opposite to the repelling force between the magnets 110 and the pin tumbler magnets 126, it will be understood that in fact the repelling force between the magnets 144 and 126 will be equal to the sum of the repelling force between the magnets 126 and 110 and the weight of the magnets 126 when in unlocked condition. Clearly, if any magnet 144 in key 138 is of too great field strength, it will repel its associated magnet 126 to cause it to straddle outer shear plane 122; if too weak a field, it will permit magnet 126 to straddle inner shear plane 124. In either such instance, lock 100 remains locked. It will further be required that magnets 126 may or may not all be of the same field strength. The critical field strength are those of magnets 110 and 144, not magnets 126.

Figure 8:
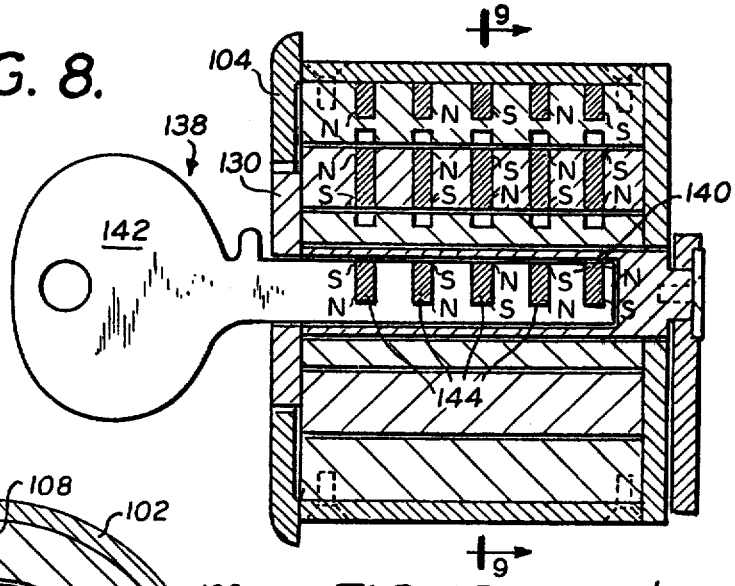
FIG. 8 is a view similar to FIG. 6, but showing the key inserted in the lock and the lock in an unlocked condition.
Figure 9:
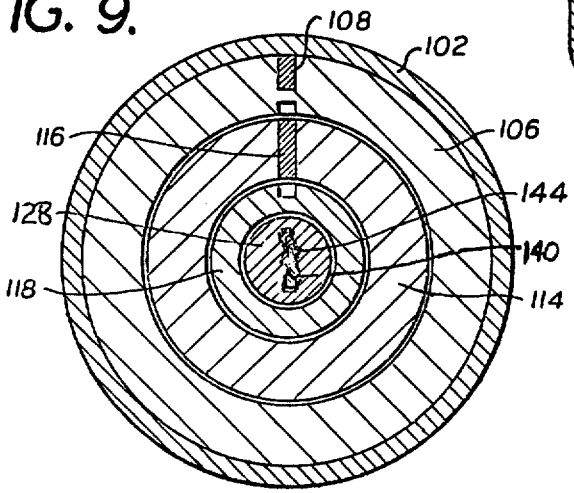
FIG. 9 is a sectional view taken along the line 9—9 of FIG. 8.

It should be noted that each magnet grouping is an aligned group of magnets 110, 126 and 144, does not have to be poled the same as other magnet groups as required in lock 10. Thus, as shown in FIGS. 6 and 8, some of the pin tumbler magnets 126 have their north poles "N" extending upwardly and some have their north poles "N" extending downwardly with corresponding adjustments in orientation made for magnets 110 and 144. This further enhances the resistance of the lock to unauthorized entry as it increases the number of key combinations necessary to open a lock by a factor of $2^{A-1}$, where A is the number of pin tumblers. Thus, the mathematical expression for determining the number of combinations is $(2X)^A$. For example, a five-pin lock with four effective field strengths available will yield 36,768 possible combinations. Naturally, in addition it is desired that the field strengths of the magnets 108 and 144 differ from grouping to grouping by predetermined amounts so as to greatly increase the numbers of permutations and combinations of possible keys for opening the lock, as already described in connection with lock 10. The matter of arriving at the appropriate field strength is similar to that of lock 10 previously described and may be achieved in any of the ways already noted. As was true of lock 10, all of the components of lock 100 save for the magnets are preferably made of non-magnetic material such as brass, and the magnets may be made of any magnetic materials such as those previously mentioned.

To assemble lock 100, the shell is first preferably joined to the flange front plate 104 in any suitable manner as by soldering, brazing, welding or the like. Of course, in the alternative, the two parts can be formed integrally as by machining or by casting and post machining. The stator assembly is formed by connecting the outer stator annulus 106 and the inner stator annulus 118, in concentric relation, to the back plate 119. The manner of connection may again be in any suitable fashion, such as soldering, brazing, welding or the use of screws.

Again, if desired, the stator assembly made up of parts 106, 118 and 119 could be integrally formed as by machining or by casting and post machining. Likewise, the rotor assembly should be formed including in concentric relationship the outer rotor annulus 114 and the rotor cylinder 128, both of which are joined to the front plate as by brazing, soldering, welding or the like. Clearly, the keyway 132 is preferably formed prior to the rotor assembly, as are the through holes 116 in the rotor annulus 114. Of course, the entire rotor assembly could be integrally formed by machining or by casting and post machining.

Magnets 110 are then fitted into recesses 108 in the outer stator annulus 106. Preferably they are press fitted to fixedly hold the magnets against possible movement resulting from the repelling magnetic forces to be encountered. If desired, adhesive may be employed to assist in the fixing of the magnets 110 in the cavities 108. Of course, such fixing of the magnets serves only to facilitate the assembly of the lock. Once the stator is within the shell of the lock, the location of the magnets 110 will be fixed.

Magnets 126 may be slidably disposed within the radial passages 116 in the rotor annulus 114. Once this is done, the rotor is oriented coaxial with the stator, but with the magnets 126 at a significant angle from the magnets 110, at least about 90°, preferably 180°. In this connection, it will be clear that it is preferred that the magnets 126 be horizontally oriented at this time to prevent them from dropping out of the rotor under the influence of gravity. The rotor and the stator are then nested, one within the other. Since the magnets 110 are remote from the magnets 126 during the nesting operation, there will not be sufficient magnetic force to shift the magnets 126 out of their respective through holes 116. Once the two parts are fully nested, the rotor may be turned relative to the stator to bring the magnets 110 and 126 into register. This will result in the magnets 126 being repelled by the magnets 110 into the cavities 120 in the inner stator annulus 118 and thereby lock the rotor to the stator. The rotor and stator locked together are then inserted into the shell from the rear thereof until the back plate 119 engages the rear of the shell. The stator may then be secured to the shell as by the screws 105, although, clearly, other means for effecting such securement will be apparent to the skilled art worker, such as soldering, brazing, welding or the like. Thereafter, the lever 136 is secured to the rotor cylinder 128 in a conventional manner and the lock 100 is fully assembled.

It will be seen that the flat key lock 100 does not require a supplementary means for preventing unlocking by demagnetization since all of the pin tumbler magnets 126 are biased by gravity downwardly to bridge the shear plane 124, whereby if they are demagnetized they will remain in that position on a fail-safe basis. It will also be apparent to those skilled in the art that biasing springs may be employed to bias the pins 126 rather than or in addition to gravity in which case the strength of the repelling magnets 144 on the keys 138 would have to be adjusted to overcome spring bias as well as the gravity bias and the repelling forces of the corresponding magnets 110 in the stator.

Devices may be available or may be developed which include a probe disposable in keyway 132 and capable of determining the polar orientation of the pin tumblers 126. Such a device might also determine the field strength of the pin tumblers. However, as already noted, the field strength of the pin tumblers is not critical to the operation of the lock 100—they may be anything so long as the tumblers are magnetized. However, it is preferable that they not all be of the same field strength as this will further enhance the pick resistant quality of lock 100. It is the field strengths of magnets 110 and their counterpart magnets 144 in the key 138 that are the critical parameters. With the structure of lock 100, this is not determinable. Thus, such a measuring instrument could not decode the lock 100. However, by determining the polar orientation of the pin tumblers 126, there would be a significant reduction in the number of possible keys needed to open the lock. In the example described hereinbefore, the number of possibilities, once the polar orientation of the pin tumblers was discovered, would be reduced by the factor $2^A$. Thus, for the five pin locks with four effective field strengths available, the number of possible keys would be reduced from 36,768 to 1,024. While this is still a high number of keys and would make the unauthorized operation of the lock at least impracticable, if there is concern, the lock 100 can be modified as shown in FIG. 10 to handle this particular problem.

Figure 10:
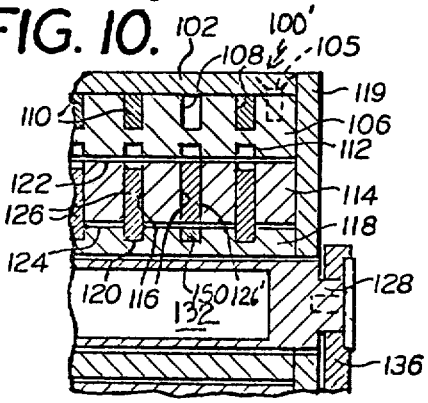
FIG. 10 is a fragmentary view similar to FIG. 6 showing a modification thereof.

Specifically, referring to FIG. 10, the lock 100' is identical to the lock 100 save for the inclusion in one or more of the cavities 120 in the inner stator annulus 118 of a slug 150 which fills the cavity 120 and causes its companion or opposed pin tumbler 126' to ride between the two shear planes 122 and 124 when the lock 100' is in its locked condition. In addition, no repelling magnet 110 is disposed in the companion aligned cavity 108 in the outer stator annulus 106, that space being left empty or being filled by an unmagnetized slug (not shown).

With this arrangement, if a probe is inserted into the keyway 132 to probe the polar orientation of the pin tumblers 126, the pin tumbler 126' will be identified as having a particular polar orientation. Thus, a key will be selected with a magnet 144 that will align with the pin tumbler 126' and will have a polarity to repel the pin tumbler 126'. When such magnet 144 is brought into confronting relation with pin tumbler 126', the pin tumbler will be repelled. However, there will be no magnet 110 operating on the magnet 126' to counterbalance the repelling force from the magnet 144. Thus, the pin tumbler 126' will move up into the cavity 112 in the outer stator annulus 126 to stradle the shear plane 122 and maintain the lock locked. Since the location of what might be called the blind pin tumbler 126' can be in any one of the pin tumbler positions, this will save to counterbalance the effect of the determination of the polar orientation of the pin tumbler magnets and thus maintain the lock essentially inviolate.

From the foregoing, it will be seen that by providing a movable part, hereinbefore designated as a rotor, between stator portions to define two shear planes, and by disposing within the movable part pin tumblers that are able to bridge either of the shear planes upon encountering certain forms of magnetic fields, and by relying on magnetic repulsion rather than attraction, an essentially pick-proof lock may be constructed which defies unauthorized opening in any contingency short of total destruction.

Figure 11:
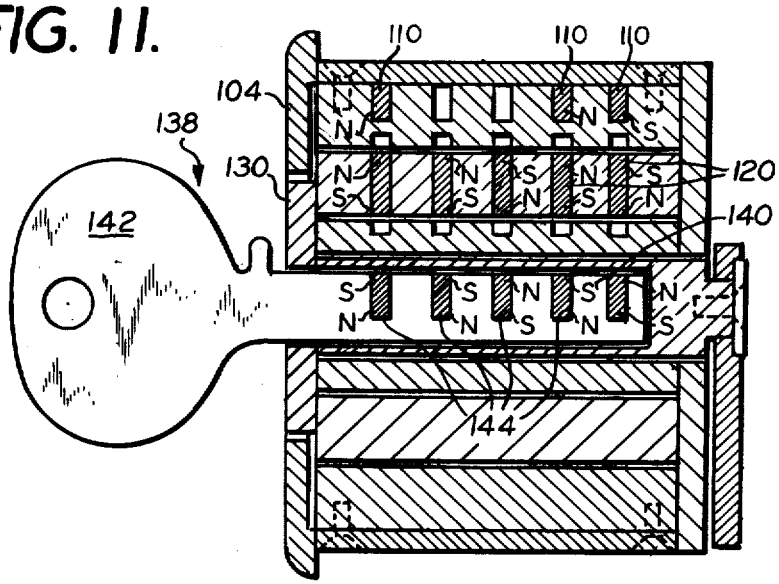
FIG. 11 is a view similar to FIG. 6 showing a modified form of lock wherein gravity is employed for biasing some of the pin tumbler magnets.

As previously mentioned in connection with the embodiments shown in FIGS. 6 through 10, the downward bias on the magnetic pin tumblers 126 may be as a result, in part or in whole, of other forces than magnetic repulsion, such as, for example, gravity. In FIG. 11, another form of lock of the general type shown in FIGS. 6 through 10 is illustrated, wherein the downward bias on the pin tumblers 126 is with respect to at least one of the pin tumblers, here shown as two in number, to be wholly due to the weights of the pin tumbler magnets, i.e., wholly due to gravity. Thus, with reference to FIG. 11, there is no repelling magnet 108 in the second and third positions from the front 104 of the lock so that the only biasing force urging these two tumblers in the second and third positions downwardly will be gravity, i.e., the weight of the tumblers. Preferably, although not necessarily, the two pin tumbler magnets are of different weights. The remaining positions for the stator magnets 110 are shown to be filled with magnets, which magnets may be of the same field strength or of differing field strengths, the latter being preferred. However, in a presently exisiting model of the invention construction solely for the purpose of demonstrating the feasibility of the invention (and not incorporating the best mode presently contemplated), all of the pin tumbler magnets are of equal weight and the three biasing magnets are of equal field strength. Such model thus requires a key with properly poled magnets 144 of two different field strengths. In any event, the downward forces on the pin tumblers 126 which must be overcome by the key magnets 144 will be different at different positions. Hence, more than just polarity need be determined to construct a key 142 that can successfully open the lock of FIG. 11. Moreover, since the presence or absence of the magnets 110 and their respective field strengths must be determined through the pin tumblers 126, there is not known to applicant any method or apparatus of making such a determination. The difficulty of decoding such a lock is further enhanced by virtue of the fact that all of the pin tumbler magnets 126 need not be of the same field strengths, but can be of different field strengths as their field strength is not critical to the operation of the FIG. 11 lock nor to any other embodiment of the invention. Thus, in the FIG. 11 embodiment, the force repelling the pin tumbler magnets 126 from the stator differs from pin tumbler to pin tumbler, although the difference need not be entirely due to variations in the magnetic field strength of the magnets 110 as was true in the FIG. 6 embodiment. Clearly, the variation in downward biasing or repelling force from the outer position of the stator is a function of tumbler weight and magnetic repulsion. It will be obvious that gravity bias requires the pin tumblers to be oriented substantially vertically.

Figure 12:
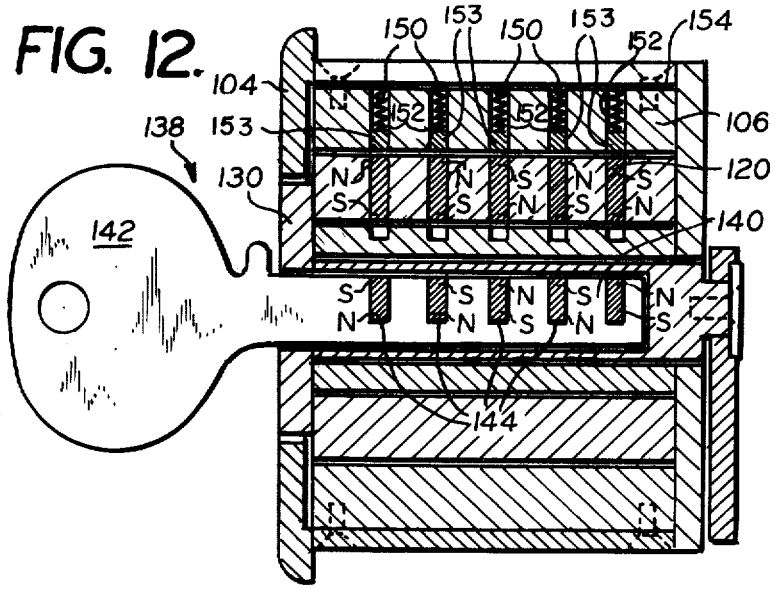
FIG. 12 is a longitudinal sectional view similar to FIG. 6 wherein the biasing means for the pin tumbler magnets are shown as springs.

Referring now to FIG. 12, still another means for biasing the pin tumblers 126 away from the outer stator shell 106 is shown. In FIG. 12, there are no repelling magnets 110 as there were in FIGS. 6 and 11, although such magnets can be included at one or more pin tumbler positions. Instead, a plurality of springs 150 are disposed in throughholes 152 in the outer stator shell 106 in lieu of the magnets 110. They may be retained in holes 152 by a slidably removable cover 154 disposed in an elongated notch in shell 102. The force exerted by the springs 150 on the pin tumblers 126 are not equal. At least one spring preferably presses its pin tumbler with a different force than the others, whereby to require the magnets 144 in the key 142 to have different field strengths in order to exert different repelling forces on the pin tumbler magnets 126 to equalize the different downward forces of the springs 150 so as to move the pin tumbler magnets in their unlocked position as illustrated in FIG. 12. Most preferably, these or more different spring forces are employed. A lock such as the FIG. 12 embodiment is essentially pick proof and undecodable and there is no nondestructive way for a burglar or the like to gain access to the springs 150 in order to measure their different spring contants on which the strength of the magnet 144 will be dependent.

Preferably, in any embodiment of the invention relying in whole or in part on springs 150 for biasing the pin tumblers downwardly toward the keyway 132, the springs do not directly engage the upper ends of the magnetic pin tumblers 126. Instead, and as is known in conventional spring bias pin tumbler locks, suitable drivers 153 are interposed between the pin tumblers and the springs. The plane of abutment between the magnetic pin tumblers and the drivers will be in the upper shear plane of the lock when the pin tumbler is in its unlocked position.

It will be obvious to anyone skilled in the art that while it may be preferable to employ compression springs 150 to bias pin tumbler magnets 126 towards the inner stator annulus, tension springs disposed within the rotor or the inner annulus of the stator may be employed to accomplish the same purpose.

It will be apparent from the foregoing description that the present lock will operate on the principle of magnetic repulsion where varying magnetic fields are required in order to appropriately position the pin tumblers between the two spaced apart shear planes irrespective of the nature of the biasing force operating from the outer stator shell 106. Thus, as shown in the FIG. 6 embodiment, the repelling force can come from magnet 108; in the FIG. 11 embodiment, the repelling force can come from gravity; and in the FIG. 12 embodiment, the repelling force can come wholly from springs. Clearly, it will be obvious that a combination of these forces may be employed in any one lock. For example, in the FIG. 11 lock, some of the pin tumblers are biased by gravity and others by repelling magnets 110. Obviously, other combinations of biasing means such as springs and magnets or springs and gravity or all three may be employed, either acting on separate pin tumbler magnets or together on the same pin tumbler magnet. Similarly, springs may be substituted for magnets in the FIG. 1 embodiment in whole or in part as may gravity if the lock is properly oriented. All three forms of bias are available in the FIG. 1 embodiment, assuming proper orientation.

In addition, individual pin tumblers may be biased in part by springs and in part by gravity or in part by springs and in part by magnets. Finally, all three may be employed together to bias an individual pin tumbler. In any of these embodiments, since it is the downward force on the pin tumbler which provides the key for decoding the lock and making operative key 142, each of these variations remains wholly pick resistant since there is no way of gaining access to the springs or to the pin tumblers to measure the force acting upon them. Unlike most conventional locks, the pin tumblers do not communicate with the keyway.

Figure 13:
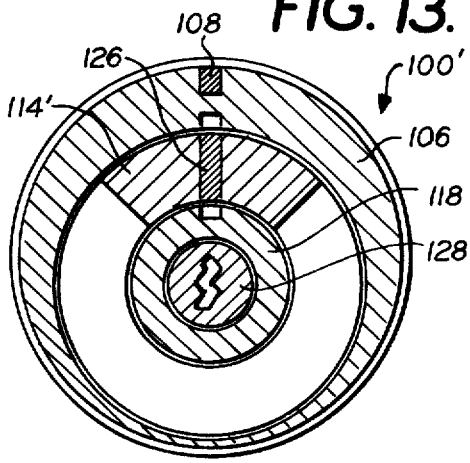
FIG. 13 is a sectional view similar to FIG. 9, but showing a modified lock.

Referring now to FIG. 13, a modified form of the lock illustrated in FIG. 6 is shown, which lock because of certain design expedients may be of smaller size and less weight than the FIG. 6 embodiment. Thus, for example, in the lock 100' of FIG. 13, while the inner rotor plug 128 and the inner stator annulus 118 are cylindrical and concentric, the outer stator annulus 106 is cylindrical and eccentric relative to the inner stator annulus whereby to provide sufficient material 106 for maintaining biasing magnets 108 (or springs 150) at the upper element of the lock, the material at the lower element of the lock is substantially reduced whereby to permit an overall reduction in the diameter of the outer casing of the lock. This particular expedient is well known in locks and is preferred in connection with the present invention.

Continuing reference to FIG. 13, an additional means for reducing the amount of material in the lock of the present invention without any reduction in its pick resistance or its overall strength is shown by the structure of the outer portion 114' of the rotor of the lock. Heretofore, such portion has been described annular. However, much of the material of the annulus 114 that is remote from the locations for the pin tumbler magnets 126 performs no significant function and may be removed whereby to render the outer portion 114' of the rotor an arc of the annulus rather than the entire annulus.

Figure 14:
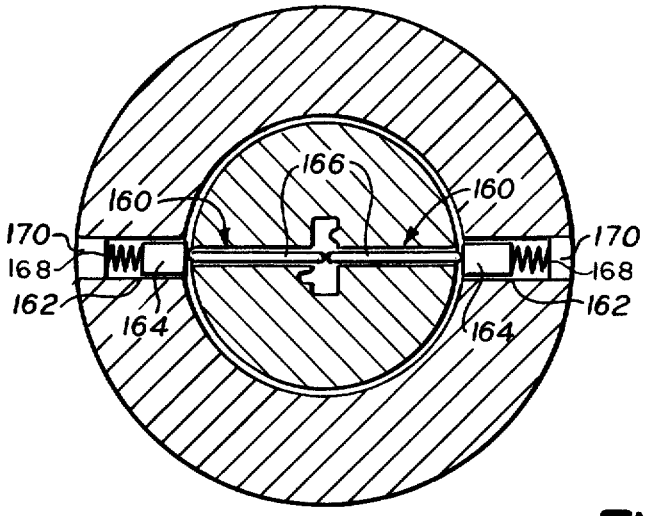
FIG. 14 is a transverse sectional view of a lock embodying means for resisting torquing of the lock.
Figure 16:
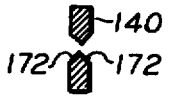
FIG. 16 is a sectional view taken along the line 16—16 in FIG. 15.
Figure 15:
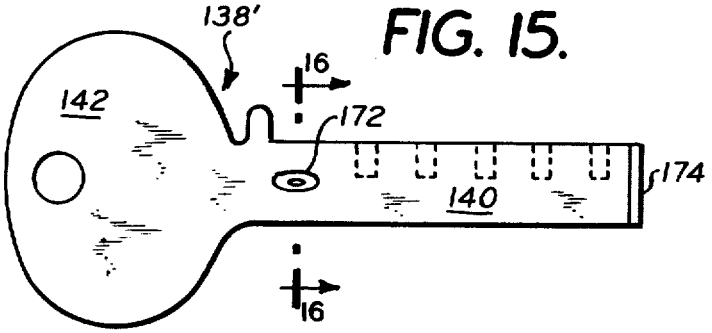
FIG. 15 is a side elevational view of a modified form of key for use with a lock equiped with the anti-torquing means of FIG. 14.

Referring now to FIGS. 14 to 17, an additional optional means for further improving the security of the locks of the present invention is shown. The keyways 144 for the locks of any of the varieties hereinbefore described may necessarily be somewhat larger in cross-section than normally encountered prior art keyways due to the dimensional requirements of magnet 144 mounted on the keys 138. This gives rise, albeit somewhat slightly, to the possibility of a burglar or the like sliding a rod of considerable cross-section into the keyway and then torquing the rotor as by a wrench or the like to sheer off the pin tumbler magnets 120 and thereby open the lock. Such a possibility can be reduced by encasing the pin tumbler magnets in a steel jacket which will greatly improve the sheer resistance of the pin tumbler, as will be described hereinafter. Moreover, and as shown in FIGS. 14 to 16, a supplementary means to resist such unauthorized torquing of the lock may be included in any of the locks heretofore described as having a flat keyway 144.

Referring now to FIGS. 14 to 16, extending into the keyway 144, preferably from both sides and preferably at the very front of the keyway in the vicinity of the front plate 130 or immediately to the rear of the side front plate, are a pair of radially extending passages 160 having enlarged portions 162 outward of the shear plane for a reason that will become apparent hereinafter.

Slidably disposed in the plug portions of each of the cavities 160 is a hardened shear resistant pin 166 having a length equal to the radius of the plug 128 of the lock. The inner ends of said pins are preferably rounded for reasons which will become apparent hereinafter. Slidably disposed in each enlarged portion 162 is a driver 164 which is biased into engagement with adjacent pin 166 by a compression spring 168 that bears at its outer edge against a fixed plug 170 which closes its passage 160 as by threads, adhesives, solder or the like. In the position shown in FIG. 14, the outer edges of the pins 160 are clear of the shear plane so as to not obstruct the operation of the lock. However, it will be obvious that if anything of any significant transverse dimension is inserted into the keyway 144, it will force the pins 160 radially outward from the illustrated position in FIG. 14, whereby to bridge the shear plane and further resist unauthorized torquing of the lock. As already stated, these pins 160 are of extremely shear resistant materials, such as, for example, a high strength alloy steel and the like and greatly enhance the strength of the lock against such tampering.

However, means must be included in the key 138', illustrated in FIG. 15, to deactivate the FIG. 15 anti-tampering mechanism when an authorized key is inserted into the lock to open it. Such means are shown as tear drop cavities 172 on both side surfaces of the shank 140 of the key 138', which cavities 172 preferably communicate in the median plane of the shank. When the key 138' is inserted into the keyway, it will move the pins 160 outwardly by virtue of the camming action of the chiseled shape front end 174 of the shank 140. The pins will remain in their outward position until the key is fully inserted in the keyway at which point the grooves 172 will register with the pins 160 and permit them to move back to the illustrated position of FIG. 15 where they will in effect engage one another through the grooves 172. This will permit the pins 160 to be out of the shear plane between the outer surface of the inner rotor part 128 and the inner surface of the stator portion 118. Assuming the key is appropriate for the lock, the lock will now be opened. The reason for the particular tear shape of the grooves 172 is to facilitate the removal of the key from the lock. Specifically, the forward portion of the groove is of ever diminishing depth so as to permit easy camming of the passages 160 outwardly as the key is removed from the keyway.

It is recognized that a burglar might attempt to force opening of the lock by sticking a rod into the keyway and then twisting it, which rod would be provided with the same tear shaped cavities as are provided in the key. However, it is highly unlikely that this could be done successfully because the rod used to torque the lock would have to be sufficiently weakened by virtue of the inclusion of the tear shaped cavities that it would shear off in the plane of those cavities rather than being successful in breaking the pin tumbler.

As previously noted, the various magnets employed in the lock and the key may be made of any well known magnetic materials, including magnetic steel, the various alnicos and the like. However, recently some very highly magnetic alloys have been developed that are commonly termed salurium cobalt alloys which produce extremely high magnetic fields. Moreover, these salurium cobalt alloys are very resistant to de-magnetization by conventional means, which de-magnetization resistance would be further enhanced if such materials were employed in the locks of the present design by virtue of the fact that the magnets would be considerably removed spacially from any device generating an AC field for the purpose of de-magnetizing these locks. Thus, salurium cobalt alloys and other high remanence alloys should be considered when constructing locks embodying the present invention.

Figure 17:
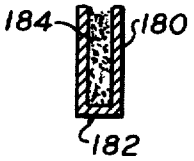
FIG. 17 is a longitudinal sectional view of a pin tumbler magnet.

It has been previously mentioned that it may be desirable to encase the magnetic materials for the pin tumbler magnets in an outer jacket. The encasing produces several desirable results. First of all, most of the magnetic materials included in this invention are sintered and thus have fairly low shear strength. To enhance the shear strength of such materials, a cylindrical tubular jacket may be employed to encase the sintered magnetic material, which jacket should be of high shear strength material, such as high strength alloy steels and the like. In addition, such jacket may reduce the friction between the pin tumbler magnets and the rotor wall to make the lock operate more easily. Such a pin tumbler is illustrated in FIG. 17 wherein the hollow tubular jacket 180 is closed at one end 182 but is opened at its outer end for the reception of the sintered magnetic material 184 therein. The upper end can be closed if desired or it may be left opened.

Figure 18:
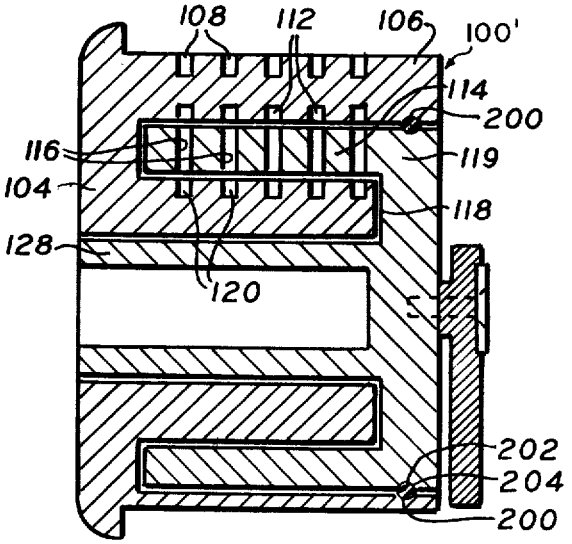
FIG. 18 is a longitudinal sectional view, similar to FIG. 6, showing yet a further modification of the invention.

It will be obvious to anyone skilled in the art that a variety of means and methods for assembling locks of the present type may be employed without departing from the present invention. The structures hereinbefore described are satisfactory and desirable. Another structure which will perform satisfactorily and may have certain advantages in the construction of the lock is illustrated in FIG. 18 wherein the lock is designated by the reference numeral 100'. This structure is a counterpart of the FIG. 6 structure (as modified by FIG. 13), although clearly, it may be employed in the embodiments of the invention shown in FIGS. 11 and 12, whether including or not including the FIG. 13 modification. Referring to FIG. 18, the structure primarily is composed of only two parts, a unitary stator structure comprising the outer stator annulus 106 which extends outwardly from a front plate 104 which connects to the inner stator annulus 118. This forward or front structure from which the two annuli 106 and 118 extend perpendicularly can be integral with the annuli and all machined or otherwise formed at one time. Clearly, the apertures or cavities 108 and 112 will be included in the outer stator and the cavities 120 to the inner stator. In addition, an annular groove 200 is provided in the inner surface of the outer stator 106 in the rear end thereof for reasons that will become apparent.

Turning now to the rotor of the lock 100', this rotor may also be formed as a unit, preferably integrally. Thus, the rotor unit will include an outer rotor annular portion 114 which extends forwardly from a rear plate 119, and an inner plug 128 that extends inwardly from the rear plate 119. Preferably, although not necessarily, these two longitudinally extending rotor portions and plate 119 are integral. Also, as will be obvious, throughholes 116 must be provided in the outer annular portion 114 of the rotor for slidably receiving the pin tumbler magnets 126. The throughholes will, of course, be registrable with the blind holes 112 and 120 in the stator. Also provided in the rotor structure adjacent the rear surface thereof is an annular groove 202 that is registrable with the annular groove 200 in the stator when the rotor and stator are nested together as illustrated in FIG. 18. To assemble the lock 100' after the magnets and tumblers are appropriately locked, all that need be done is to dispose an O-ring 204 on the rotor groove 202 and then to slide the stator and rotor portions toward one another. When the O-ring snaps into the grooves 200 in the stator annulus 106, it will lock the rotor and stator against further longitudinal movement to hold the lock in assembled condition without interferring with rotation therebetween.

Clearly, the parts could be reversed so that the rotor portions are joined together along the front surfaces of the lock and the stator portions are joined along the rear portions of the lock without departing from the thrust of the immediately preceding description.

It will be obvious to anyone skilled in the art that any of the locks described herein can be master keyed by employing known master keying techniques. Thus, for example, with reference to the lock of FIG. 12, master keying can be achieved by employing pin tumbler magnets 126 that are of shorter length than the length of the rotor passages 120 with the balance of the length of said passages filled by a second driver, the drivers having various lengths. When the pin tumblers 126 and the additional unillustrated drivers are both wholly disposed within the outer annulus of the rotor of the lock, as by the insertion of the key 138, the lock can open in a standard fashion as already described. However, when a master key is inserted into the lock, the unillustrated drivers can be moved up wholly into the shell cavities together with the drivers 152 with the pin tumbler magnets 126 remaining in passages 120, whereby the lock can be turned by separating the pin tumblers from their respective drivers. Clearly, a different key 138, that is a key with different magnets 144 therein, would be required to achieve this. Such a key could be the master key and could be employed in connection with a large number of different locks of the FIG. 12 type all requiring different keys for standard opening, but all responding to a single master key for master key opening as above described. Similar master keying could be achieved in connection with the other embodiments of this invention, although, clearly, the shell passages must be long enough to receive the extra drivers upon insertion of the master key. Other conventional ways of effecting master keying may also be adapted to the locks described hereinbefore.

While I have shown and described the preferred embodiments of the present invention and have suggested many modifications therein, other changes and modifications may be made therein within the scope of the appended claims without departing from the spirit and scope of this invention.

What is claimed is:

1. A magnetic lock for operation by a key having a plurality of spaced apart magnets of different field strengths, said lock comprising:

a stator and a movable part, said stator having two spaced apart portions on opposite sides of said movable part to define two spaced apart shear planes, said movable part being movable to and from a locked position;

both stator portions having a like plurality of recesses in their respective surfaces that confront said movable part, said recesses being in alignment and being alignable with the key magnets;

said movable part having a like plurality of spaced apart through holes in alignment with said cavities when said movable part is in said locked position for rendering said through holes alignable with said key magnets;

a like plurality of pin tumbler magnets slidably disposed in said through holes, said pin tumbler magnets being of no greater longitudinal extent than said through holes; and a like plurality of means, one for each pin tumbler magnet, for biasing each of said pin tumbler magnets toward one of said stator portions, at least two of said pin tumbler biasing means exerting different biasing forces on said pin tumbler magnets, whereby when said key is juxtaposed adjacent to said one stator portion and said key magnets are registered with said pin tumbler magnets and of effective field strength and polarity to repel said pin tumbler magnets with a force equal to the different biasing forces on said pin tumbler magnets, said pin tumbler magnets will be out of both said shear planes to unlock said lock.

2. The magnetic lock of claim 1, wherein at least one of said biasing means is a magnet in the other of said stator portions poled to repel its associated pin tumbler.

3. The magnetic lock of claim 1, wherein at least one of said biasing means is solely the weight of said pin tumbler.

4. The magnetic lock of claim 3 wherein at least one other of said biasing means is magnets poled to repel the pin tumbler magnet biased thereby.

5. The magnetic lock of claim 1, wherein at least one of said biasing means is a spring.

6. The magnetic lock of claim 5, wherein said spring is a compression spring mounted in the other of said stator portions.

7. The magnetic lock of claim 1, wherein all of said biasing means are magnets poled to repel said pin tumbler magnets.

8. The magnetic lock of claim 7, further comprising means for locking said movable part against movement relative to said stator effective upon the demagnetization of said magnets.

9. The magnetic lock of claim 8, wherein said locking means comprises another magnet, said other magnet being mounted within said lock for movement between a first position clear of said shear planes and a position straddling one of said shear planes, a further magnet for holding said other magnet in said first position, and a spring for biasing said other magnet to said second position, the biasing force of said spring being less than the holding force of said further magnet, whereby, said other magnet remains in said first position unless said further magnet is substantially demagnetized.

10. The magnetic lock of claim 1, wherein said movable part is a rotor in the form of a circular disc having two surfaces, and said through holes extend axially through said disc.

11. The magnetic lock of claim 10, wherein said stator comprises two plates in parallel close confronting relation with the two surfaces of said rotor, and wherein said biasing means are magnets fixed to one of said two plates.

12. The magnetic lock of claim 11, wherein each of said stator plates has a central aperture, and said rotor disc has opposed axially extending bosses disposed in said central apertures for rotatably mounting said rotor in said stator.

13. The magnetic lock of claim 12, further comprising a handle for turning said rotor, said handle being coaxial with said rotor disc and operatively secured to the bosses disposed in the aperture of the other of said two plates.

14. The magnetic lock of claim 13, wherein said biasing means, said throughholes and said recesses are respectively arranged in circular rows.

15. The magnetic lock of claim 14, further comprising a disc-like key positionable adjacent the other of said stator plates, said key including a like plurality of magnets registrable with said pin tumbler magnets and of effective field strength and polarity to repel said pin tumbler magnets with equal forces to the biasing forces on said pin tumbler magnets by said biasing means.

16. The magnetic lock of claim 15, further comprising means for releasably holding said key in said position adjacent the other of said stator plates.

17. The magnetic lock of claim 15, wherein all of said biasing means are magnets poled to repel said pin tumbler magnets.

18. The magnetic lock of claim 1, wherein said stator is formed from two spaced apart concentric annuli and said movable part in a rotor comprising an annulus rotatably mounted between said two stator annuli, said throughholes extending radially through said rotor annulus.

19. The magnetic lock of claim 18, wherein at least one of said biasing means is a magnet.

20. The magnetic lock of claim 19, wherein at least said magnet and one of the other of said biasing means exert different bias forces.

21. The magnetic lock of claim 20, wherein said biasing magnet is fixed to the outer of said stator annuli.

22. The magnetic lock of claim 21, wherein said rotor further comprises a cylinder rotatably mounted within the inner stator annulus and fixed to said rotor annulus for rotation therewith, said rotor cylinder having a longitudinally extending keyway therein.

23. The magnetic lock of claim 22, wherein said keyway has an irregular cross-section.

24. The magnetic lock of claim 18, wherein said rotor further comprises a cylinder rotatably mounted within the inner stator annulus and fixed to said rotor annulus for rotation therewith, said rotor cylinder having a longitudinally extending keyway therein.

25. The magnetic lock of claim 24, further comprising a key comprising a longitudinally extending shank insertable in said keyway, and a like plurality of magnets distributed along said shank for registration with said pin tumbler magnets, said key magnets being poled and of such effective field strengths as to exert equal and opposite repelling forces on said pin tumbler magnets as do said biasing means.

26. The magnetic lock of claim 25, wherein said keyway and said key shank have complimentary irregular cross-sections.

27. The magnetic lock of claim 18, further comprising an additional radially extending throughhole in said rotor annulus, an additional pin tumbler magnet slidably disposed in said additional throughhole, said outer stator annulus having an additional recess in its inner surface, said additional recess being in alignment with said additional pin tumbler magnet and proportioned to receive the outer end portion thereof, said outer stator annulus being substantially free from means for biasing said additional pin tumbler magnet, the other surface of said inner stator annulus being free of a recess capable of receiving the inner end portion of said additional pin tumbler magnet.

28. The magnetic lock of claim 18, wherein at least one of said biasing means is solely the weight of said pin tumbler magnet and the other biasing means are magnets poled to repel the other of said pin tumbler magnets.

29. The magnetic lock of claim 18, wherein all of said biasing means are springs.

30. The magnetic lock of claim 29, wherein said springs are compression springs mounted in the outer stator annulus.

31. The magnetic lock of claim 30, a like plurality of drivers interposed between said compression springs and said pin tumbler magnets.

32. The magnetic lock of claim 1, further comprising a key having spaced apart magnets registrable with said pin tumbler magnets and of effective field strength and polarity to repel said pin tumbler with forces equal to the different biasing forces on said pin tumbler magnets.

33. The magnetic lock of claim 1, further comprising an additional throughhole in said movable part, an additional pin tumbler magnet slidably disposed in said additional throughhole, said one stator portion having an additional recess in its surface which confronts said movable part, said additional recess being in alignment with said additional pin tumbler magnet and proportioned to receive the confronting end portion thereof, said one stator portion being substantially free from biasing means for repelling said additional pin tumbler magnet, the surface of said other stator portion which confronts said additional pin tumbler magnet being free of a recess capable of receiving the other end portion of said additional pin tumbler magnet.

34. The magnetic lock of claim 33, wherein said stator is formed from two spaced apart concentric annuli and said movable part is a rotor comprising an annulus rotatably mounted between said two stator annuli, said throughholes extending radially through said rotor annulus.

35. The magnetic lock of claim 1, wherein at least two of said biasing means are solely the weights of two pin tumblers, said weights being different.

36. The magnetic lock of claim 1, wherein all of said biasing means are springs.

* * * * *